United States Patent [19]

Williams

[11] Patent Number: 4,579,381

[45] Date of Patent: Apr. 1, 1986

[54] FLEXIBLE UTILITY STRETCHER

[76] Inventor: James D. Williams, 3700 Westfall Dr., Encino, Calif. 91436

[21] Appl. No.: 576,744

[22] Filed: Feb. 3, 1984

[51] Int. Cl.[4] ..... A61G 1/02

[52] U.S. Cl. ..... 296/20; 5/82 R

[58] Field of Search ..... 296/20; 5/82 R, 81 R, 5/86; 280/400, 403; 16/19, 45, 29

[56] References Cited

U.S. PATENT DOCUMENTS

| | | | |
|---|---|---|---|
| 1,546,617 | 7/1925 | Caldwell et al. | 280/43 |
| 1,924,496 | 8/1933 | Herod | 296/20 |
| 2,174,434 | 9/1939 | Beaufour | 296/20 |
| 2,781,525 | 2/1957 | Bauer | 296/20 |
| 3,346,890 | 10/1967 | Thompson | 5/82 |
| 3,577,573 | 5/1971 | Mrnak | 5/82 R |
| 4,037,871 | 7/1977 | Bourgraf et al. | 296/20 |

*Primary Examiner*—Robert R. Song

*Attorney, Agent, or Firm*—Blakely, Sokoloff, Taylor & Zafman

[57] ABSTRACT

A flexible utility stretcher is disclosed for use by paramedics, ambulance operators and other emergency vehicle personnel whose duties include the use of utility stretchers to transport patients to an emergency vehicle. The stretcher comprising the subject invention generally corresponds to the size and shape of utility stretchers presently employed by paramedics and other emergency personnel who use emergency vehicles in connection with their duties. The main features which distinguish the subject invention from prior art utility stretchers are telescoping side frame members and a pivot point at approximately the center of the stretcher separating one portion or head end of the stretcher from the other portion or foot end of the stretcher. Either half may be pivoted through an angle of up to approximately 30°. This pivoting capability allows the stretcher to be maneuvered around sharp turns which would be impossible to accomplish using a stretcher without such pivoting capability. The telescoping side frame members allow the stretcher to be shortened so that it will fit in an elevator or other relatively short space. Another important feature is that uninterrupted cardiopulmonary resuscitation can be performed on a victim being transported in the prone position with the stretcher in both the flex mode and in the shortened mode.

21 Claims, 15 Drawing Figures

FLEXIBLE UTILITY STRETCHER

BACKGROUND

1. Field of The Invention

This invention relates to utility stretchers used by paramedics and other emergency vehicle operators to transport patients from a place of injury or illness to the emergency vehicle.

2. Prior Art

The inventor is aware of the following relevant prior art references:

U.S. Pat. No. 1,151,495 issued to Menten;
U.S. Pat. No. 1,396,208 issued to Hubbard;
U.S. Pat. No. 3,122,758 issued to Ferneau;
U.S. Pat. No. 3,125,766 issued to Halperin; and
U.S. Pat. No. 3,304,116 issued to Stryker.

Copies of the foregoing references are submitted herewith pursuant to Rule 1.98. The relevance of the foregoing references to the present application is as follows:

Menten teaches a combined stretcher, cot and hammock having a provision for flexibility in the side frames for storing the stretcher or when using the stretcher as a hammock.

Hubbard discloses a stretcher capable of being maneuvered around sharp turns. The means employed by Hubbard to enable maneuvering the stretcher around sharp turns comprises bars at both ends of the stretcher which can be unlocked and removed to provide a sling which can be folded lengthwise around a patient so that the patient can be tilted and carried vertically or at another convenient orientation when it is necessary to maneuver the stretcher around sharp turns.

Ferneau teaches a combined stretcher and stair chair having a telescoping side frame and retractable wheels.

Stryker teaches hospital stetcher having four corner wheels and a fifth center wheel which is retractable.

Halperin teaches a splint stretcher having a side frame which includes telescoping segments.

Additionally, the present inventor is aware of utility stretchers presently used by paramedics and ambulance operators which correspond generally to the size and shape of the stretcher comprising the present invention.

None of the prior art stretchers known to the inventor provide a pivot point at approximately the center of the stretcher around which point the stretcher pivots to allow maneuvering in tight quarters, while allowing a patient to be maintained in a prone position. The foregoing and many other differences between the subject invention and the prior art are discussed more fully hereinbelow.

SUMMARY OF THE INVENTION

A flexible utility stretcher is disclosed for use by paramedics, ambulance operators and other emergency vehicle personnel whose duties include the use of utility stretchers to transport patients to an emergency vehicle.

The present invention is particularly useful in those situations which require that a patient be maintained in a prone position for medical reasons while being transported from tight quarters to an ambulance or other emergency vehicle. In such situations, the invented stretcher provides easy maneuverability in tight quarters while supporting the patient to allow the application of continuous cardiopulmonary resuscitation while being transported to the emergency vehicle.

The stretcher comprising the subject invention generally corresponds to the size and shape of utility stretchers presently employed by paramedics and other emergency personnel who use emergency vehicles in connection with their duties. The main features which distinguish the subject invention from prior art utility stretchers are telescoping side frame members and a pivot point at approximately the center of the stretcher separating one portion or head end of the stretcher from the other portion or foot end of the stretcher. Either half may be pivoted through an angle of up to approximately 30°. This pivoting capability allows the stretcher to be maneuvered around sharp turns which would be impossible to accomplish using a stretcher without such pivoting capability. The invented stretcher is especially useful in situations where the patient, for medical reasons, hence the stretcher, must be maintained in a prone or horizontal position while being transported.

Each of the two side frame members has a pair of telescoping portions. One telescoping portion of the pair is disposed near the mid-portion of the stretcher. The other telescoping portion of the pair is disposed near one end of the stretcher. The telescoping portions of the two side frame members near the mid-portion of the stretcher, when placed in a retracted position, allow the stretcher to flex and be maneuvered around sharp turns by the above described pivoting capability. The telescoping portions adjacent the mid-portion of the stretcher are placed in an extended position when the stretcher has sufficient space within which to maneuver, without the necessity for flexing to maneuver around sharp turns.

The telescoping side frame portion pair adjacent one of the ends of the stretcher are normally in an extended position and are placed in a retracted position when it is necessary to reduce the length of the stretcher to enable it to fit into an elevator or other relatively small space.

Additionally, when the telescoping side frame portion pair adjacent one of the ends of the stretcher is retracted, a hinged plate or cover, which fits on top of the stretcher, folds so as to form an upside-down V-shaped projection near the end of the stretcher having the retracted side frame portion pair. This upside-down V-shaped projection allows a patient who is lying on his back to have his knees flexed in situations when it is medically desirable to have knee flexion in the patient. Similarly, in situations requiring that a patient have his upper torso raised, the patient may be rotated 180° such that his back lies against the upside-down V-shaped projection.

In addition to the four wheels normally present near the four corners of the stretcher, another feature embodied in the subject invention is a fifth wheel disposed near the center of the stretcher to provide additional support for the patient, especially when the telescoping portion pair near the mid-portion of the stretcher is retracted to allow pivoting of the stretcher. This fifth wheel, in order to provide the maximum structural support when the stretcher is in use, is positioned such that the caster for the wheel can swivel around the stretcher pivot point. This fifth wheel, like the other four wheels, is capable of being retracted or folded when the stretcher is not in use so as to minimize the space taken by the stretcher when stored in the emergency vehicle.

DETAILED DESCRIPTION OF THE INVENTION

Figure 1:
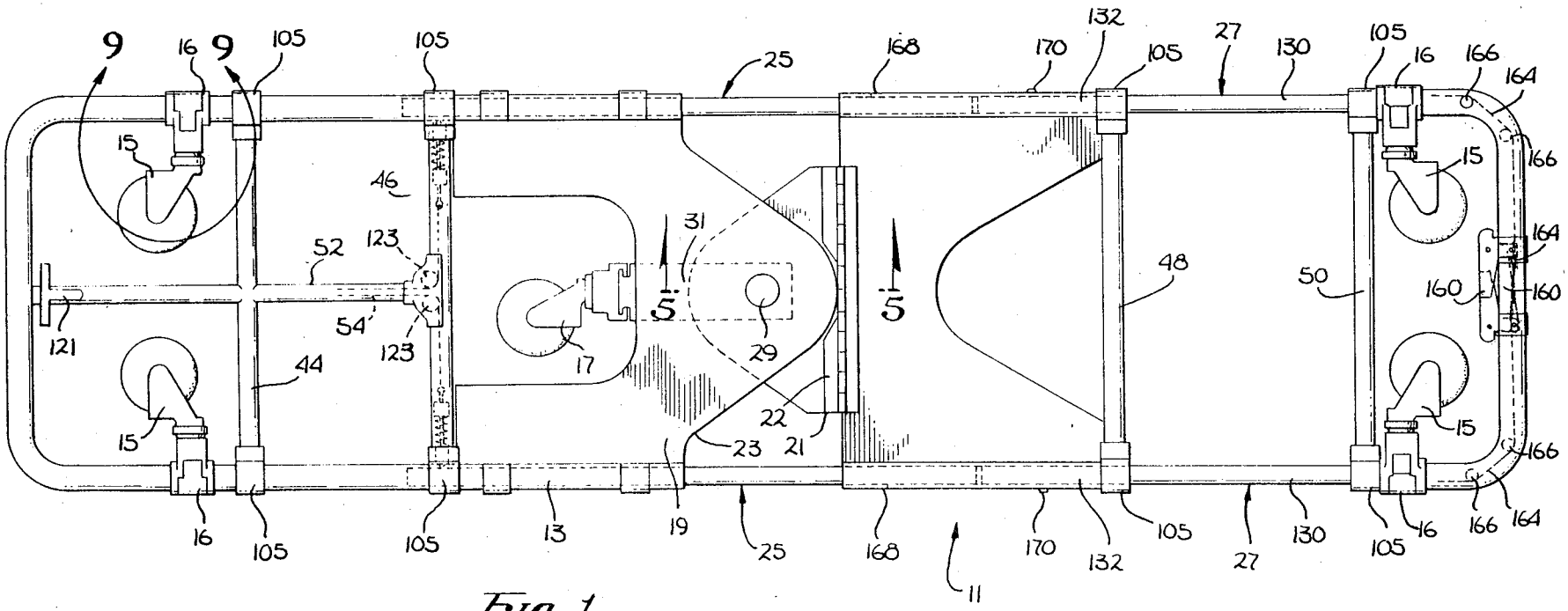
FIG. 1 is a top plan view of the invented stretcher showing the telescoping side frame members in a fully extended position and the wheel and caster assemblies in their retracted positions.

Referring to FIG. 1, a flexible utility stretcher 11 is disclosed. The stretcher comprises a generally rectangular shaped, light weight, generally tubular aluminum frame 13. Four folding wheel and caster assemblies 15 are disposed adjacent to the four corners of the frame and are held in place by clamps 16. A fifth folding wheel and caster assembly 17 is disposed such that the wheel and caster assembly, when down and in an operating position, pivots substantially at the center of the stretcher.

A top plate 19 extending from slightly past the mid-point of the stretcher, through the mid-point to a point approximately half the distance to one end (the head end) of the stretcher, is coupled to the frame 13 and disposed on a top side thereof, that is, on the side opposite the wheel and caster assemblies 15 and 17. A bottom plate 23 having approximately the same extent as the top plate 19 is coupled to the bottom side of frame 13, that is, on the opposite side thereof from the top plate 19. A middle plate 21, partially interleaved between top plate 19 and bottom plate 23, extends from a point slightly past the mid-point of the stretcher, through the mid-point, a distance approximately half way to the other end (the foot end) of the stretcher opposite plates 19 and 23. The plates 19, 21 and 23 are coupled to frame 13 by welds, suitable clamps or other means for securely connecting the plates to the frame. For reasons to be discussed below, plate 21 preferably is in two pieces coupled at hinge 22 extending the width of the plate. Inasmuch as weight is an important factor, plates 19, 21 and 23 should be made of aluminum or other strong, but lightweight material.

As noted above, the middle plate 21 is interleaved between top plate 19 and bottom plate 23 at approximately the mid-point of the stretcher 11. A king pin 29 is disposed at approximately the mid-point of the stretcher and passes through plates 19, 21 and 23.

Figure 5:
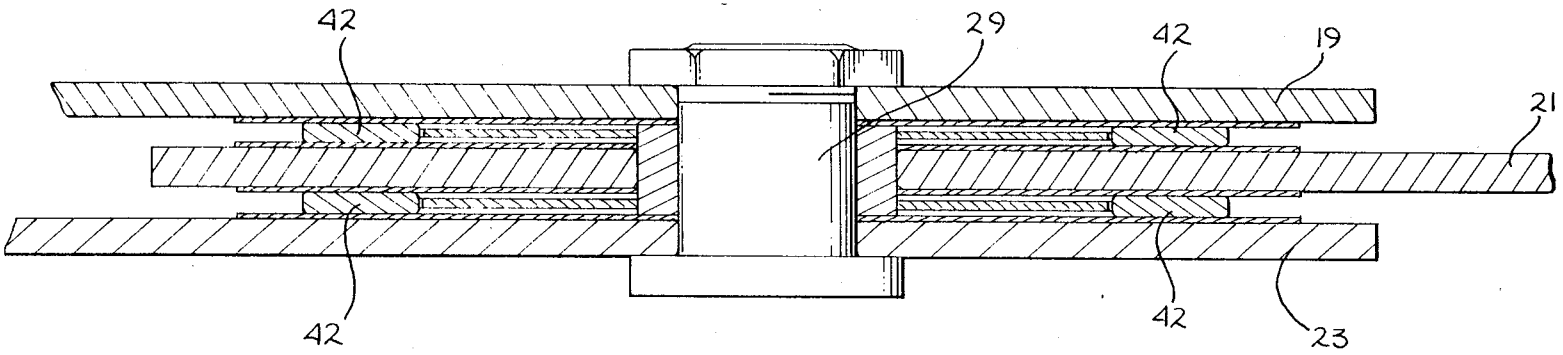
FIG. 5 is a cross-section of the king pin assembly taken along line 5—5 of FIG. 1.

Frame 13 comprises telescoping mid-portions 25 which can be retracted such that the frame is split into two portions separated from each other at approximately the middle of the stretcher. When the telescoping mid-portions 25 are retracted, the two portions of the stretcher are connected only at the king pin 29 pivot point. Accordingly, the end portions of the stretcher may be freely pivoted around the king pin 2 when telescoping mid-portions 25 are retracted. The interleaved plates 19, 21 and 23 are slightly separated from each other to allow a free pivoting motion when the telescoping mid-portions 25 are retracted. As best seen in FIG. 5, in the area adjacent king pin 29, thrust bearing surfaces 42 separate plates 19, 21 and 23.

Figure 3:
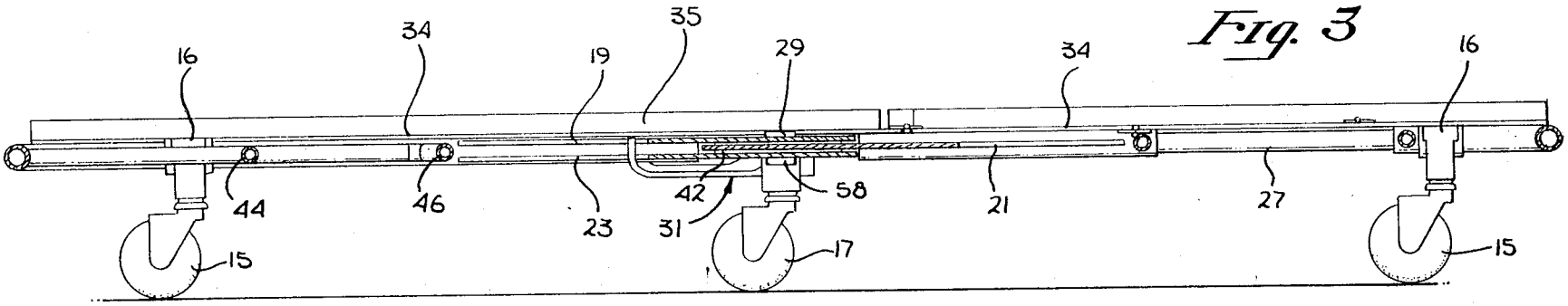
FIG. 3 is a side elevation view of the invented stretcher.
Figure 4:
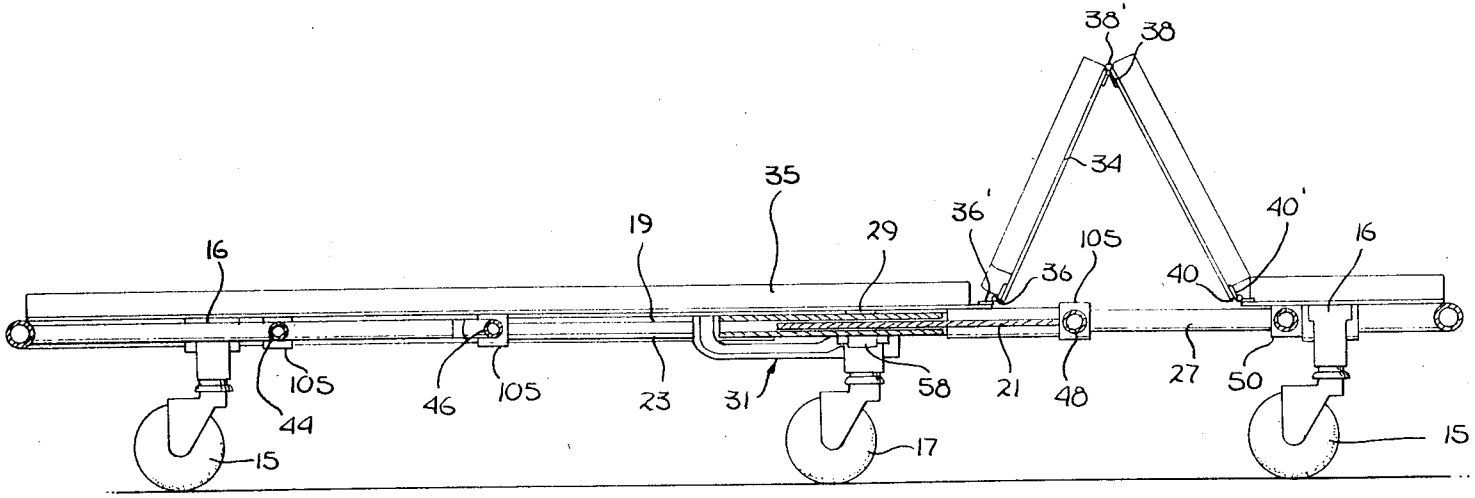
FIG. 4 is a side elevation view of the invented stretcher wherein the end telescoping portions are in a retracted position.

Frame 13 further comprises telescoping end portions 27. When telescoping end portions 27 are retracted, the overall length of the stretcher is decreased allowing the stretcher to fit into elevators and other relatively small spaces in which the full length stretcher is unable to fit. When telescoping end portions 27 are extended, the stretcher is at its full length. The stretcher further comprises, as shown is FIGS. 3 and 4, a two piece cover 34 on top of the stretcher. A two piece mattress 35 lies on top of cover 34. The portion of the cover 34 adjacent the foot end of the stretcher includes three hinges 36, 38 and 40 extending the width of the cover and disposed adjacent telescoping end portions 27. When the telescoping end portions 27 are in an extended position, cover 34 lies flat on top of the stretcher. When the telescoping end portions 27 are in a retracted position, the foot end portion of the cover flexes at hinges 36, 38 and 40 forming an upside down V-shaped section. The upside down V-shaped section enables the knees to be maintained in a flexed position. Alternatively, by rotating a patient 180°, the upside down V-shaped section is used as a back rest for a patient enabling the patient to maintain his upper torso in a raised position. The mattress 35 includes hinges 36', 38' and 40' corresponding to hinges 36, 38, and 40 of cover 34 which cause the foot end portion of the mattress to form a corresponding upside down V-shaped section when the telescoping end portions 27 are in a retracted position.

Referring again to FIG. 1, the invented stretcher further comprises a monorail assembly 31 coupling the wheel and caster assembly 17 to king pin 29. The monorail assembly 31 allows the wheel and caster assembly 17 to be placed in a retracted position when necessary to store the stretcher in an emergency vehicle and, when the stretcher is in use, to be moved into a down and operating position such that the caster and wheel assembly pivots about the mid-point of the stretcher at king pin 29. Unlike the four corner wheel and caster assemblies 15, the wheel and caster assembly 17 cannot be clamped or otherwise connected to the frame 13 of the stretcher. Thus, the monorail assembly 31 provides the structural integrity needed at the pivoting king pin 29, while allowing the wheel and caster assembly 17 to be retracted to reduce space when the stretcher is stored. In an alternate embodiment, instead of monorail assembly 31 and wheel and caster assembly 17, four wheel and caster assemblies can be coupled to the ends 26 (see FIG. 3) of frame 13 adjacent king pin 29 to provide the necessary integrity at the king pin.

The stretcher further comprises tubular cross-members 44, 46, 48 and 50 extending the width of frame 13. Two of the cross-members 44 and 46 are disposed approximately equally spaced through the head end half of the stretcher while the other two cross-members 48 and 50 are disposed approximately equally spaced through the foot end half of the stretcher. The cross-members are welded, clamped or otherwise attached to the frame and provide structural support therefor as well as support for cover 34. In a preferred embodiment, the cross-members are held in place by clip rings 105. The cover 34 is connected to the cross-members 44, 46, 48 and 50 with, for example, machine screws which extend through the cover into threaded engagement with the cross-members. Additionally, a tubular member 52, disposed at the longitudinal axis of the stretcher extends from the head end of the stretcher through cross-member 44, to cross-member 46. Cabling 54, necessary for a release mechanism to be described below, passes through members 52 and 46.

Figure 6:
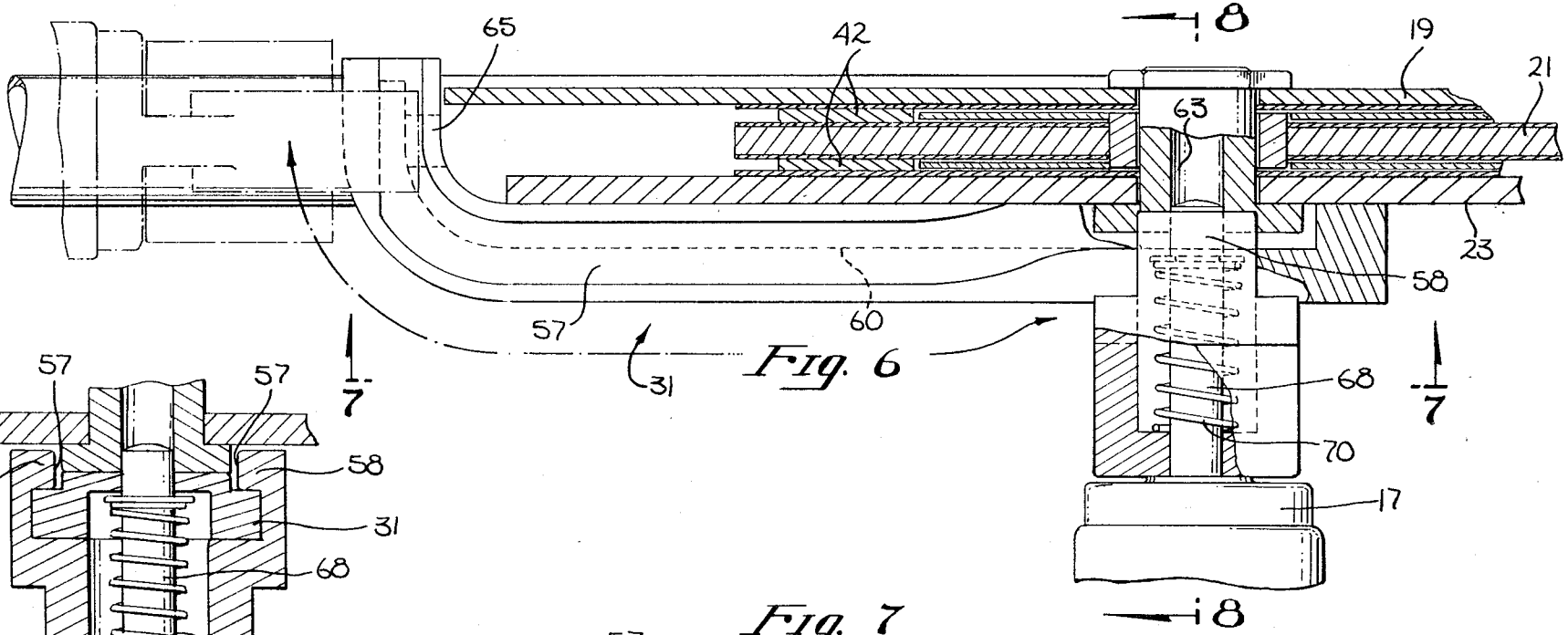
FIG. 6 is a cross-section of the monorail and wheel and caster assembly.
Figure 7:
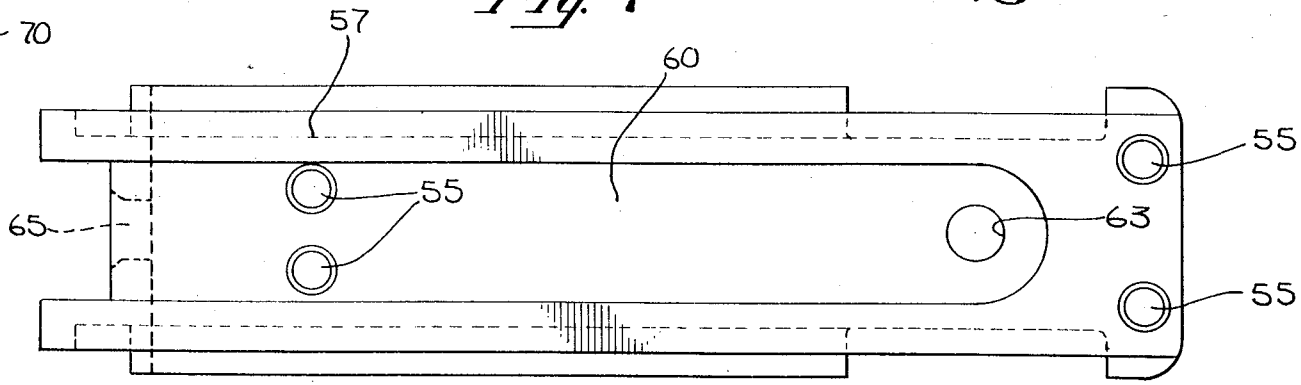
FIG. 7 is a bottom plan view of the monorail assembly taken along line 7—7 of FIG. 6.
Figure 8:
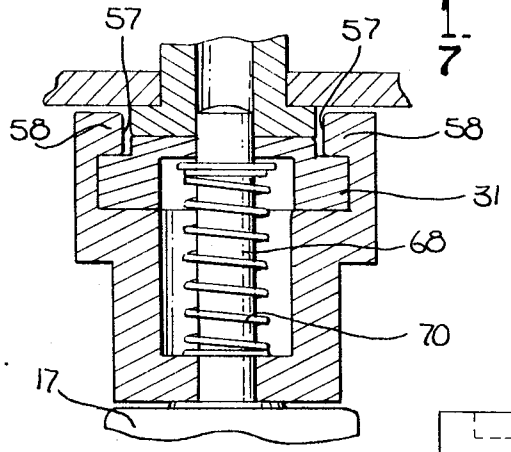
FIG. 8 is a cross-section of the monorail assembly and wheel and caster assembly taken along line 8—8 of FIG. 6.
Figure 9:
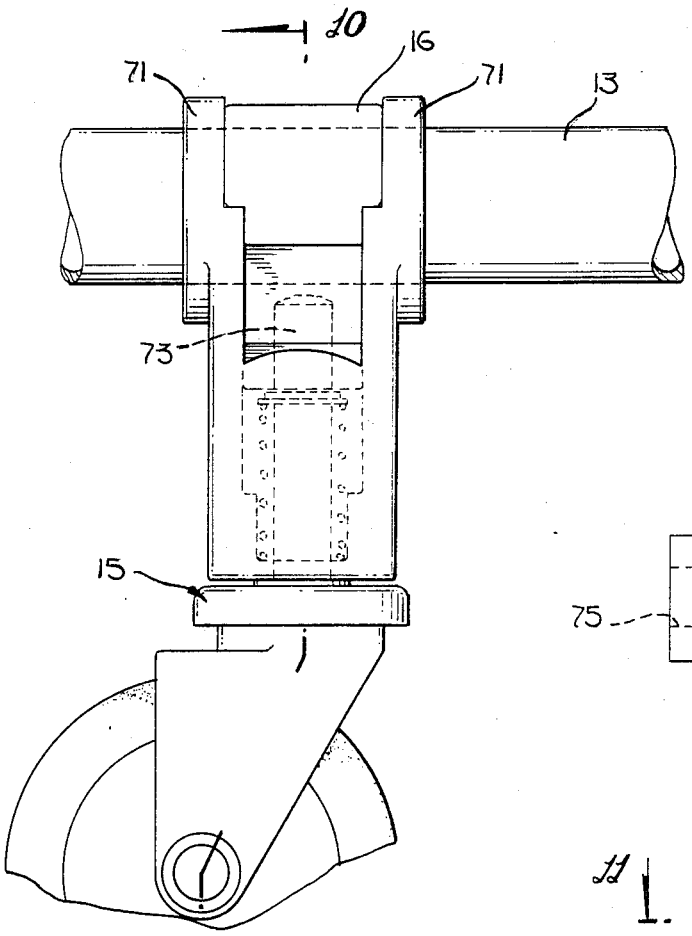
FIG. 9 is a side elevation view of a corner wheel and caster assembly in partial cut-away taken along line 9—9 of FIG. 1.
Figure 11:
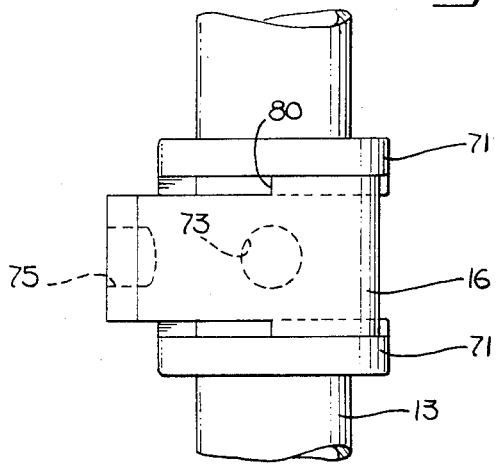
FIG. 11 is a top plan view of the wheel and caster assembly taken along line 11—11 of FIG. 10.
Figure 10:
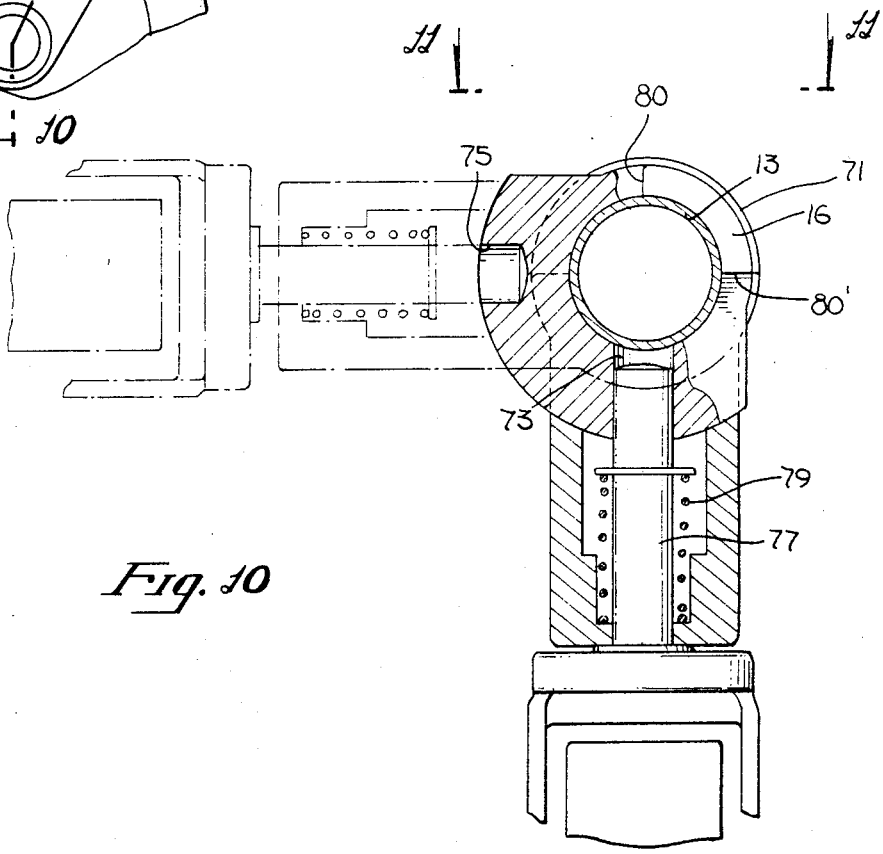
FIG. 10 is a cross-section of the wheel and caster assembly taken along line 10—10 of FIG. 9.
Figure 12:
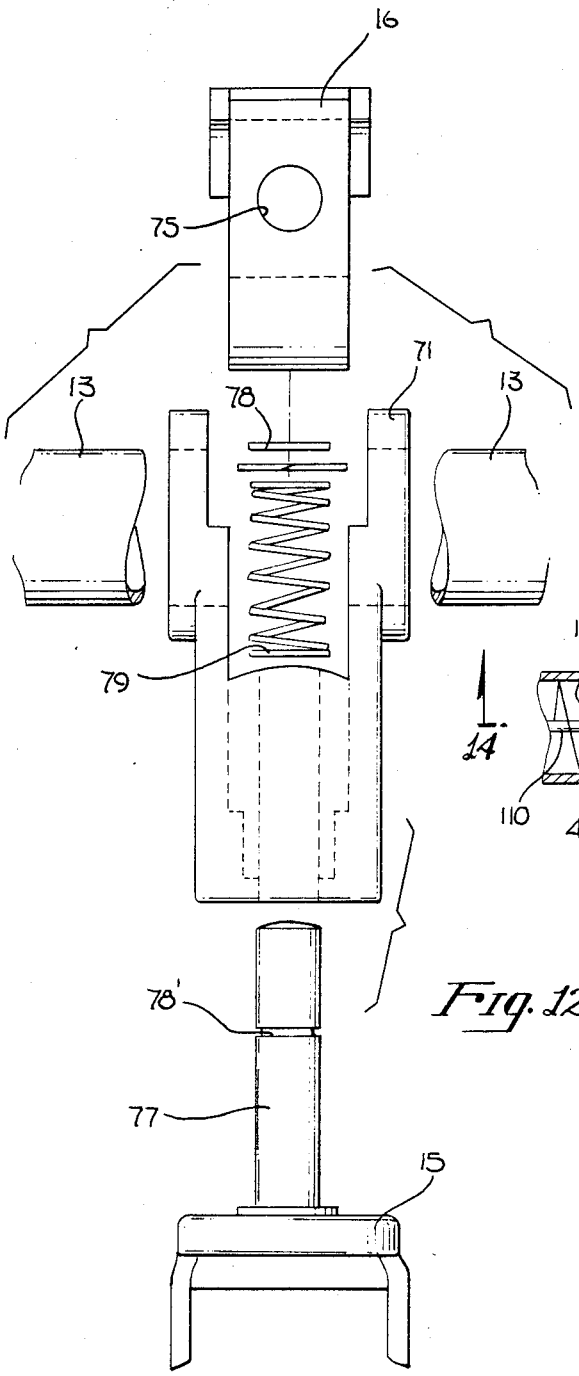
FIG. 12 is a exploded view of the wheel and caster assembly of FIG. 9.

Details of the monorail assembly 31 will now be described with reference to FIGS. 6, 7 and 8. The monorail assembly is attached to bottom plate 23 by four bolts 55 or other suitable means for insuring that the assembly is securely attached to the bottom plate 23. The assembly is generally rectangular in shape with one end formed into an angle of approximately 90° in the direction of the top surface of the stretcher. The assembly 31 includes tracks 57 disposed at its sides, only one of which may be seen in FIG. 6. A depression 60 extends the length of the assembly. Wheel and caster assembly 17 slidingly engages monorail assembly 31 with portions 58 extending into tracks 57 in a sliding relationship as best seen in FIG. 8. Wheel and caster assembly 17 includes a pin 68 which extends longitudinally through the axis of the assembly. When the wheel and caster assembly 17 is in a retracted position, pin 68 extends through bore 65 in the monorail assembly.

By pulling the wheel of wheel and caster assembly 17 to pull pin 68 out of bore 65, the assembly is free to slide the length of tracks 57 such that pin 68 engages bore 63 in the monorail assembly thereby locking wheel and caster assembly 17 into its operating position. Similarly, if it is desired to move wheel and caster assembly 17 back into its retracted position, the wheel is pulled so as to disengage pin 68 from bore 63 and the assembly is slid back along tracks 57 until pin 68 engages bore 65 thereby locking the assembly in its retracted position. Expansion biasing spring 70 disposed on pin 68 is used to hold pin 68 in bore 63 or 65 until a pulling force is applied to wheel and caster assembly 17 to disengage pin 68 from the bore.

The details of wheel and caster assemblies 15 will now be described with reference to FIGS. 9 through 12. It is to be noted that each of the four wheel and caster assemblies 15 have an identical structure. Thus, the following description applies to all four wheel and caster assemblies 15.

The wheel and caster assembly 15 includes a collar 71 having two ends with circular openings through which the frame 13 of the stretcher passes. Clamp 16 is disposed between the two ends of rotating collar 71. The clamp forms a cylindrical sleeve through which frame 13 passes. The clamp is secured to the frame by set screws (not shown) or other suitable means which bear against the frame. The clamp 16 includes a bore 73 and a bore 75 approximately perpendicular to each other. Wheel caster assembly 15 includes a pin 77 and expansion biasing spring 79 held in place by lock washer 78. By pulling on the wheel of wheel and caster assembly 15, collar 71 is free to rotate around frame 13 such that the entire wheel and caster assembly 15 rotates. If it is desired that the wheel be in an operating position, the assembly is rotated until pin 77 engages bore 73. Similarly, when it is desired that the wheel be in a retracted position, the assembly is rotated until pin 77 engages bore 75. Preferably, clamp 16 includes flanges 80 and 80' to limit the rotation of wheel and caster assembly 15 to the approximately 90° necessary for proper operation. That is, when collar 71 engages flange 80 or 80' the wheel and caster assembly is released and the force exerted by biasing spring 79 will cause the pin 77 to engage bore 75 or 73, as appropriate.

Figure 13:
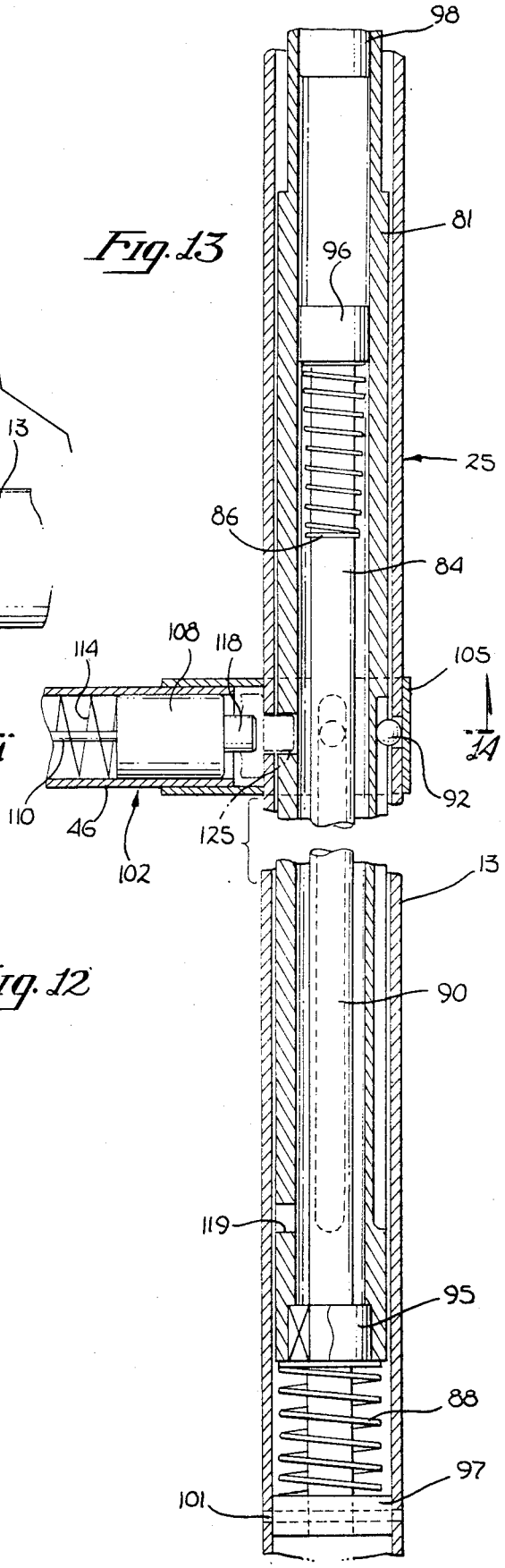
FIG. 13 is a partial cut-away of the mid-portion of a telescoping side frame member.

The details of telescoping mid-portions 25 and their associated locking mechanism will now be described with reference to FIGS. 13 and 14. Telescoping mid-portions 25 are comprised of two identical assemblies, one disposed within the head end half of frame 13 at one side thereof, and the other disposed in the head end half of frame 13 at the other side thereof. The two telescoping members 25 are identical as are the corresponding release mechanisms 102. Therefore, the following description applies to both telescoping mid-portions and release mechanisms.

Each telescoping mid-portion 25 comprises a tube 81 with a check rod 84 disposed within the tube. The check rod includes a pull spring 86 which bears against bushing 95 at one end of tube 81 and bumper 96 at one end of check rod 84 when tube 81 is in an extended position. The check rod 84 also includes a push spring 88 which bears against bushing 97, at the other end of the check rod 84 and the end of tube 81 at bushing 95 when tube 81 is in a retracted position as shown in FIG. 13. Bushing 97 is coupled to frame 13 and check rod 84 by a pin 101 through the bushing and frame, or other suitable means. After check rod 84 is inserted into tube 81, bushing 95 is coupled to tube 81 by a set screw (not shown) or other suitable means, nearest the head end of the stretcher. The other end of tube 81 has coupled thereto a rubber bumper 98. Tube 81 includes three grooves 90 equally spaced around the circumference of the tube and extending slightly more than half the length of the tube. Ball bearings 92 are inserted through openings 93 in frame 13 and held in place by clip-ring 105. The ball bearings are sized such that tube 81 is free to slide within frame 13 along grooves 90 while maintaining the tube in a relatively stable position within the frame. Bushings 95 and 97 and bumpers 96 and 98 limit the length of travel of tube 81 along check rod 84 in a manner to be described below.

Figure 14:
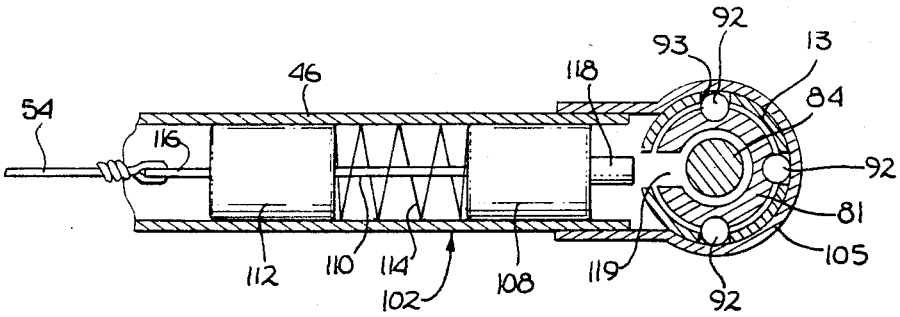
FIG. 14 is a cross-section of the telescoping side frame member taken along line 14—14 of FIG. 13.

As best seen in FIG. 14, release mechanism 102 comprises a pin 108 which is coupled to connecting member 110 which in turn passes thru guide sleeve 112. Expansion biasing spring 114 is disposed on connecting member 110 separating pin 108 from guides sleeve 112. Release mechanism 102 is disposed within cross-member 46 such that guide sleeve 112 is held stationary within cross-member 46 by set screws (not shown) threadedly engaging the cross-member and guide sleeve. In this manner, connecting member 110 and pin 108 are free to slide within cross-member 46 with the travel being limited at one end by guide sleeve 112 and at the other end by frame 13. Connecting member 110 extends through guide sleeve 112 and at the end thereof opposite pin 108 is coupled to cable 54. The cable is coupled to the connecting member by an eyelet 116 or other suitable means. Pin 108 includes a protrusion 118 which extends into a first bore 119 or a second bore 125 through frame 13 and tube 81 as described below.

The cable 54 extends from eyelet 116 through cross-member 46, around guide wheel 123 (see FIG. 1) at approximately the mid-point of cross-member 46 through tubular member 52 to the head end of the stretcher terminating at handle 121. By squeezing on handle 121, pin 108 and protrusion 118 is removed from bore 119 (or bore 125). When the handle is released, expansion biasing spring 114 forces the protrusion 118 back into bore 119 (or bore 125). When pin 108 is in its retracted position, tube 81 is free to slide along the length of check rod 84. When bore 119 is engaged by pin 108, telescoping portion 25 is in an extended position. When it is decided that the telescoping portion be locked in its retracted position, handle 121 is squeezed so as to release pin from bore 119, the telescoping portion is then moved into its retracted position, the handle is released and pin 108 engages a second bore 125 in tube 81.

Figure 15:
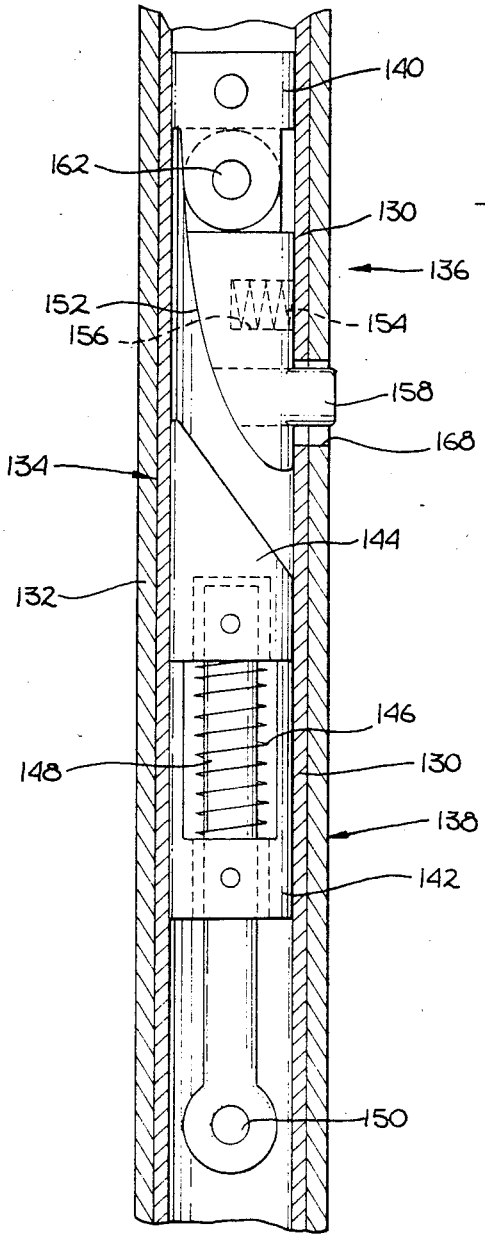
FIG. 15 is a top plan view of foot section locking mechanism.

The details of telescoping end portions 27 and their associated locking mechanisms will now be described with reference to FIGS. 1 and 15. Telescoping end portions 27 are comprised of two identical assemblies, each assembly comprising a tube 130 whose outside diameter is slightly less than the inside diameter of tube 132 such that when tube 130 is inserted into tube 132 they are engaged in a sliding relationship. Disposed within each tube 130 is a locking mechanism 134. As best seen in FIG. 15, the locking mechanism 134 is comprised of two main assemblies 136 and 138. The two assemblies 136 and 138 are connected to tube 130 with set screws (not shown) in threaded engagement with tube 130 and assemblies 136 and 138 respectively or other suitable means. With respect to assembly 136, the set screws or other suitable means engage pin boss 140, at one end thereof, while assembly 138 is attached to tube 130 by set screws which threadedly engage tube 130 and guide sleeve 142. It should be noted that assembly 138 is substantially identical to locking assembly 102 with pin 108 of the locking assembly 102 corresponding to beveled engaging member 144 of assembly 138. Thus, expansion biasing spring 146 corresponds to expansion biasing spring 114 and connecting member 110 corresponds to connecting member 148 and eyelet 116 correspond to eyelet 150.

Assembly 136 further comprises protrusion 158 and beveled surface 152 with expansion biasing spring 154 inserted in bore 156.

Normally, engaging member 144 bears against beveled surface 152 forcing the compression of spring 154. When handles 160 at the foot end of the stretcher are squeezed, cables 164 are pulled. The ends of cables 164 opposite the handle 160 pass through frame 13 around guide wheels 166 and are coupled to each eyelet 150 such that when the cables are pulled, each connecting member 148 is pulled through sleeve 142 which in turn disengages engaging member 144 from beveled surface 152. At such time, the force exerted by spring 154 causes assembly 136 to pivot within tube 130 at pivot point 162. Tube 132 includes two bores 168 and 170 through one of which protrusion 158 extends, depending on whether the end portions 27 are retracted or extended. By pulling on handles 160 thereby releasing protrusion 158 from one of the bores 168 or 170, tubes 130 are free to slide within tubes 132. When the handles 160 are released, the tubes 130 will continue to slide until protrusion 158 engages one of bores 168 or 170 at which time the force exerted by engaging member 144 on beveled surface 152 will force protrusion 158 through one of said bores thereby locking telescoping end portions 27 in either a retracted or extended position. Protrusions 158 extend through bores 168 when the telescoping end portions are in a retracted position, and through bores 170 when the telescoping end portions are in an extended position.

Figure 2:
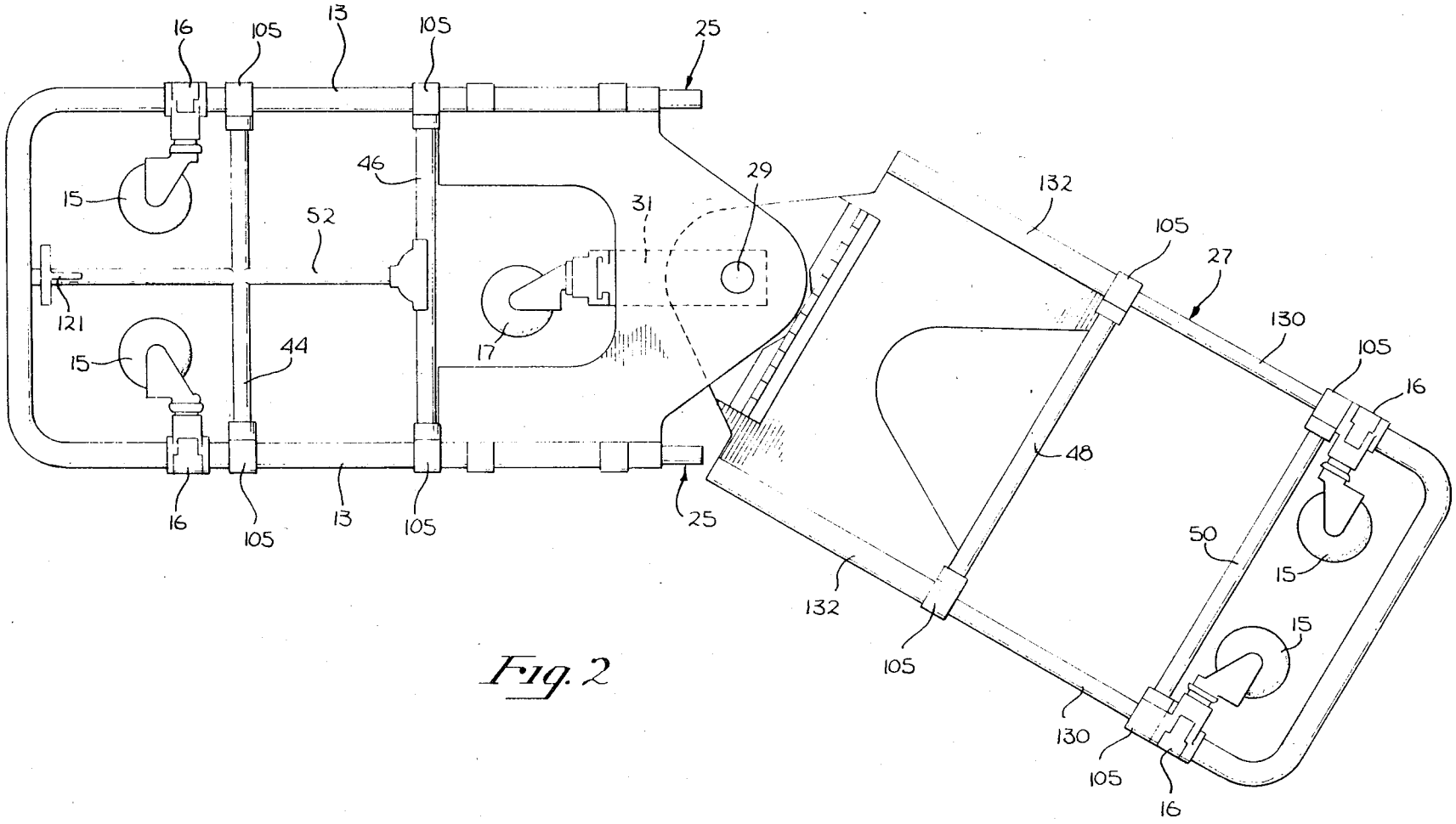
FIG. 2 is a top plan view of the invented stretcher showing the middle telescoping portions in a retracted position and the pivoting capability of the stretcher.

The operation of the stretcher will now be described. Referring first to FIG. 2, once telescoping mid-portions 25 are retracted, the stretcher is divided into two sections connected at approximately the mid-point thereof at king pin 29. As best seen in FIG. 5, king pin 29 retains plates 19, 21 and 23, passing through each plate such that the plates are free to rotate about the pin and the stretcher can be easily maneuvered through tight quarters. If necessary, cardiopulmonary resuscitation can be carried our while the stretcher is being moved because the disclosed king pin 29 and wheel caster assembly 17 provide adequate support even when telescoping mid-portions 25 are retracted. While the plates are free to rotate, the range of rotation is limited by the obstruction created by frame 13 when the stretcher is flexed as shown in FIG. 2. While this range of rotation may be increased by decreasing the length of telescoping mid-portions 25, as a practical matter, there is no need to allow for rotation of greater than approximately 30° inasmuch as a torso of a patient on the stretcher would ordinarily not flex more than the capability of the stretcher.

After the stretcher has been maneuvered through tight quarters and the flexing capability of the stretcher is no longer needed, by squeezing handle 121, each tube 81 is free to slide along its corresponding check rod 84 within frame 13. At such time, force exerted by each expansion spring 88 causes tubes 81 to slide towards the foot end of the stretcher. By lining up the foot end and head end of the stretcher such that the side rails of frame 13 are aligned, tubes 81 may be pulled towards the foot end of the stretcher until protrusion 118 of locking pin 108 engages bore 119 thereby locking the telescoping mid-portions in an extended portion.

When the length of the stretcher must be shortened to fit into a small space, or the knees of the patient must be flexed, or the head of the patient must be in a raised position, telescoping end portions 27 may be retracted as follows. Firstly, telescoping mid-portions 25 should be locked in their retracted positions so that each tube 130 is free to slide the entire length of tube 132. At such time, handles 160 are squeezed thereby releasing protrusion 158 from bore 170 as above-described. Tubes 130 are then free to slide within tubes 132 and the foot end of the stretcher may be moved towards the head end of the stretcher. By continuing to move the foot end of the stretcher towards the head end of the stretcher, protrusions 158 will engage bores 168 and the telescoping end portions 27 will be locked in a retracted position. When it is desired that the stretcher again be extended to its full length, handles 160 are squeezed thereby releasing protrusion 158 from bores 168 and the foot end of the stretcher is pulled away from the head end of the stretcher until protrusions 158 engage bores 170. As noted above, when telescoping end portions 27 are retracted, hinged cover 34 flexes at hinges 36, 38 and 40 to thereby form an inverted V-shaped portion which supports the patient's knees when knee flexion is desired or necessary, or the upper torso of the patient when desired or necessary.

It should be noted that when telescoping mid-portions are retracted and the foot end and head end of the stretcher are connected only at king pin 29, if the head end or foot end of the stretcher is lifted, a large force will be applied to king pin 29 as well as plates 19, 21 and 23. Accordingly, a hinge 22 extends the width of metal plate 21 such that if either end of the stretcher is raised when telescoping mid-portions 25 are retracted, the stretcher will flex at hinge 22, and no undue force will be exerted on king pin 29 or plates 19, 21 or 23.

Generally, when the stretcher is to be stored in the emergency vehicle, telescoping mid-portions 25 and telescoping portions 27 are in their extended positions. Wheel and caster assemblies 15 and 17 are in their retracted positions in order to minimize the space taken up by the utility stretcher in the emergency vehicle.

Thus, the flexible utility stretcher has been described. Although numerous details have been set forth regarding materials used and means for implementing the various mechanical linkages and other such requirements, those skilled in the art will recognize that other materials may be used and different means may be employed for implementing the various mechanical linkages and the like of the stretcher without departing from the spirit and scope of the invention as set forth in the claims appended hereto.

What is claimed is:

1. A utility stretcher comprising:

(a) a generally rectangular frame having a first portion coupled to a second portion by pivot means, said pivot means for allowing said first and second portions to be coupled in a pivoting relationship;

(b) means for allowing the stretcher to be rolled along a surface;

(c) first and second covering means coupled to said first and second portions of said frame respectively for supporting patients to be transported by said stretcher; and (d) support means for supporting the stretcher at the pivot means;

wherein said support means comprises a wheel and caster assembly coupled to said pivot means and disposed adjacent thereto.

2. The utility stretcher defined by claim 1 wherein said rolling means comprises four wheel and caster assemblies coupled to said frame, one of said wheel and caster assemblies disposed adjacent each of the four corners of said frame wherein said wheel and caster assemblies include means for retracting said wheel and caster assemblies and wherein said retracting means comprises for each wheel and caster assembly, a collar rotatably coupled to said frame, and first and second bores for engaging a spring biased locking pin portion of said wheel and caster assembly, said first bore for locking said wheel and caster assembly in a retracted position and said second bore for locking said wheel and caster assembly in an operating position.

3. The utility stretcher defined by claim 1 wherein said wheel and caster assembly includes means for retracting said wheel and caster assembly.

4. The utility stretcher defined by claim 3 wherein said retracting means comprises a monorail assembly coupled to said pivot means and wherein said wheel and caster assembly is slidingly coupled to said monorail assembly, said monorail assembly having first and second bores for engaging a spring biased locking pin portion of said wheel and caster assembly, said first bore for locking said wheel and caster assembly in a retracted position and said second bore for locking said wheel and caster assembly in an operating position.

5. A utility stretcher comprising:

(a) a generally rectangular frame having a first portion coupled to a second portion by pivot means, said pivot means for allowing said first and second portions to be coupled in a pivoting relationship;

(b) means for selectively locking said first and second portions to each other, whereby pivoting of said first and second positions is prohibited when said locking means is engaged;

(c) means for allowing the stretcher to be rolled along a surface; and (d) first and second covering means coupled to said first and second portions of said frame respectively for supporting patients to be transported by said stretcher wherein said locking means comprises a pair of telescoping members disposed inside the first portion of said frame, one of each of said pair of telescoping members disposed at opposite sides of said frame, whereby when said telescoping members are in an extended position, said telescoping members engage the second portion of said frame in a locking relationship, and when said telescoping members are in a retracted position, said telescoping members are disengaged from the second portion of said frame.

6. The utility stretcher defined by claim 5 wherein said telescoping members are spring biased and include first means for locking said members in the retracted position and second means for locking said members in the extended position.

7. The utility stretcher defined by claim 5 further comprising support means for supporting the stretcher at the pivot means.

8. The utility stretcher defined by claim 7 wherein said support means comprises a wheel and caster assembly coupled to said pivot means and disposed adjacent thereto.

9. The utility stretcher defined by claim 5 wherein said rolling means comprises four wheel and caster assemblies coupled to said frame, one of said wheel and caster assemblies disposed adjacent each of the four corners of said frame.

10. The utility stretcher defined by claim 9 wherein said wheel and caster assemblies include means for retracting said wheel and caster assemblies.

11. The utility stretcher defined by claim 10 wherein said retracting means for each wheel and caster assembly comprises a collar rotatably coupled to said frame, and first and second bores for engaging a spring biased locking pin portion of said wheel and caster assembly, said first bore for locking said wheel and caster assembly in a retracted position and said second bore for locking said wheel and caster assembly in an operating position.

12. The utility stretcher defined by claim 8 wherein said wheel and caster assembly includes means for retracting said wheel and caster assembly.

13. The utility stretcher defined by claim 12 wherein said retracting means comprises a monorail assembly coupled to said pivot means and wherein said wheel and caster assembly is slidingly coupled to said monorail assembly, said monorail assembly having first and second bores for engaging a spring biased locking pin portion of said wheel and caster assembly, said first bore for locking said wheel and caster assembly in a retracted position and said second bore for locking said wheel and caster assembly in an operating position

14. A utility stretcher comprising:

(a) a generally rectangular frame having a first portion coupled to a second portion by pivot means, said pivot means for allowing said first and second portions to be coupled in a pivoting relationship;

(b) means for selectively locking said first and second portions to each other, whereby pivoting of said first and second portions is prohibited when said locking means is engaged;

(c) means for allowing the stretcher to be rolled along a surface;

(d) means for selectively shortening and lengthening said second portion wherein said means for selectively shortening and lengthening said second portion of said frame comprises a pair of telescoping members disposed inside said second portion, one of each pair of said telescoping members disposed at opposite sides of said frame, each of said members including first and second means for locking said members in a retracted position and extended position respectively; and (e) first and second covering means coupled to said first and second portions of said frame respectively for supporting patients to be transported by said stretcher wherein said second covering means includes three hinges extending the width of said covering means, whereby when said telescoping members are locked in a retracted position, said second covering means bends to form a back rest or knee rest for a patient lying on the stretcher.

15. The utility stretcher defined by claim 14 further comprising support means for supporting the stretcher at the pivot means.

16. The utility stretcher defined by claim 15 wherein said support means comprises a wheel and caster assembly coupled to said pivot means and disposed adjacent thereto.

17. The utility stretcher defined by claim 14 wherein said rolling means comprises four wheel and caster assemblies coupled to said frame, one of said wheel and caster assemblies disposed adjacent each of the four corners of said frame.

18. The utility stretcher defined by claim 17 wherein said wheel and caster assemblies include means for retracting said wheel and caster assemblies.

19. The utility stretcher defined by claim 18 wherein said retracting means comprises for each wheel and caster assembly a collar rotatably coupled to said frame, and first and second bores for engaging a spring biased locking pin portion of said wheel and caster assembly, said first bore for locking said wheel and caster assembly in a retracted position and said second bore for locking said wheel and caster assembly in an operating position.

20. The utility stretcher defined by claim 16 wherein said wheel and caster assembly includes means for retracting said wheel and caster assembly.

21. The utility stretcher defined by claim 20 wherein said retracting means comprises a monorail assembly coupled to said pivot means and wherein said wheel and caster assembly is slidingly coupled to said monorail assembly, said monorail assembly having first and second bores for engaging a spring biased locking pin portion of said wheel and caster assembly, said first bore for locking said wheel and caster assembly in a retracted position and said second bore for locking said wheel and caster assembly in an operating position.

* * * * *